United States Patent [19]

Stritzl et al.

[11] Patent Number: 4,973,072

[45] Date of Patent: Nov. 27, 1990

[54] SKI BRAKE

[75] Inventors: Karl Stritzl; Andreas Riegler, both of Vienna; Hubert Wurthner, Hainburg; Franz Luschnig, Traiskirchen; Henry Freisinger; Johann Zotter, both of Vienna; Friedrich Leichtfried, Traiskirchen; Andreas Janisch, Tribuswinkel; Helmut Wladar, Vienna, all of Austria

[73] Assignee: TMC Corporation, Baar, Switzerland

[21] Appl. No.: 302,694

[22] PCT Filed: May 18, 1987

[86] PCT No.: PCT/EP87/00261

§ 371 Date: Jan. 17, 1989

§ 102(e) Date: Jan. 17, 1989

[87] PCT Pub. No.: WO88/09197

PCT Pub. Date: Dec. 1, 1988

[51] Int. Cl.[5] ..... A63C 7/10

[52] U.S. Cl. ..... 280/605

[58] Field of Search ..... 280/604, 605

[56] References Cited

U.S. PATENT DOCUMENTS

| | | | |
|---|---|---|---|
| 4,087,113 | 5/1978 | Riedel | 280/605 |
| 4,173,354 | 11/1979 | Murata | 280/605 |

FOREIGN PATENT DOCUMENTS

| | | | |
|---|---|---|---|
| 1483/86 | 5/1987 | Austria . | |
| 045698 | 2/1982 | European Pat. Off. . | |
| 2751602 | 5/1979 | Fed. Rep. of Germany | 280/605 |
| 2900527 | 8/1979 | Fed. Rep. of Germany | 280/605 |
| 2902317 | 8/1979 | Fed. Rep. of Germany | 280/605 |
| 3136079 | 3/1983 | Fed. Rep. of Germany . | |

*Primary Examiner*—Charles A. Marmor
*Assistant Examiner*—Eric Culbreth
*Attorney, Agent, or Firm*—Finnegan, Henderson Farabow, Garrett & Dunner

[57] ABSTRACT

This ski brake (1) has two wire brake arms (7) which are pivotally mounted on a base plate (2) and whose end sections (**7*d*) are linked together by a connecting spring (8), whereby the ski brake (1), in its standby position, is held against the top of the ski by an actuating treadle (5) pressed down against the force of at least one mounting spring (6), and whereby the free ends (7*a*) of the wire brake arms (7) are swung in toward the longitudinal axis of the ski (10**).

In order in this ski brake (1) to improve, during the pressing down of the actuating treadle, the flux of force from the base plate (2) onto the wire brake arms (7), the invention provides that there is hinged to the end sections (**7*d*) a connecting link (9) comprised of a cylindrical sleeve (9*a*) with an extension (9*b*) joined thereto, with the latter being braced in the standby position against a supporting surface (2*f*) of the base plate (2**).

13 Claims, 9 Drawing Sheets

SKI BRAKE

BACKGROUND OF THE INVENTION

The present invention relates to a ski brake.

DESCRIPTION OF THE PRIOR ART

A ski brake of this kind is described in DE-OS 31 36 079. In the case of this ski brake, a displacement member is mounted on the base plate. When the actuating treadle is depressed, this displacement member causes the connecting spring to bend, thereby causing the free ends of the two wire brake mandrels to swivel in the direction of the vertical longitudinal medium plane of the ski brake. The disadvantage of this ski brake is that the force required to effect the swivelling motion is applied to the middle of the spring that connects the two wire brake mandrels. Consequently, this spring is subject to a high degree of stress, particularly because the angled ends of the wire brake mandrels are inserted into the spring are spaced a distance from the middle of the spring.

This then was the reason that the suggestion was made, in the case of another ski brake (s.A. 1483/86) that the connecting spring be provided with a U-shaped (in top view) deflection in its middle section. The crossbar of the deflection would be guided in or against a guide track in the base plate. When this is done, however, dimensioning of the U-shaped deflection is dependent on the dimensions and the material of the connecting spring. Finally, a ski brake is described in EP-Al 45 698, in which the end segments of the wire brake mandrels are angled and face each other. The connecting spring between the end segments is designed as a leaf spring and is firmly fastened to an actuating treadle. A consequence of this construction, however, is that the leaf spring is subject not only to bending stress, but additionally to torsional stress as well, when the ski brake is depressed on and the brake is swivelling upwards. In this case, the raising of the two wire brake arms is effected by means of a connecting rod, hinged to the treadle at one end and outfitted with a piston at its other end. This piston is guided in a cylindrical housing and is acted upon by a pressure spring. In the standby position, the leaf spring (which is deflected in the braking position) is swung around an angle guide, which causes the leaf spring to bend back and the ends of the wire brake arms carrying the brake blades to rotate inwards.

The object of the invention is to eliminate the disadvantages of the known constructions and to create a ski brake in which the working surfaces of the force that swivels the wire brake arms in are also in the vicinity of the angled ends of the wire brake arms, so that the connecting spring is subject to less bending stress from the direct application of the force. Furthermore, greater possibilities as to the selection of materials are to be provided to the designer.

SUMMARY OF THE INVENTION

Starting with a ski brake of the type described in the introduction, this object is achieved as a consequence of the present invention. By virtue of the fact that in the ski brake of the present invention the cylindrical sleeve of the connecting link extends all the way up to and over the angled end segments of the the wire brake arms, the flux of force coming from the extension is conducted to these ends, which relieves the load on the connecting spring.

Actually, it would be conceivable to provide the middle section of the sleeve with a recess. In practice, however, execution in accordance with the present invention has proven itself to be especially advantageous, particularly since the supporting surfaces of the connecting link can be made larger through this design.

Furthermore, the present invention ensures that the free end segments of the wire brake arms can swing into the standby position with reduced friction.

The present invention also ensures constant guiding of the connecting link at the base plate. When this is done, the supporting surface and the guide surfaces can be placed apart from each other, whereby the designer can more easily carry out those constructional measures that are necessary for retracting the free ends of the wire brake arms into the standby position. In addition to this, the flux of force from the base plate to the the wire brake arms is improved.

The movement range of the free end of the extension, a range fixed on one side by the guide surface, is limited on the other side as well by the present invention. The present invention also makes possible secure anchoring of the ends of both spiral springs in the extension of the connecting link. Furthermore, both spiral springs can be dimensioned longer, because their ends lie next to each other.

The design of the ski brake of the present invention allows material to be saved in the production of the connecting link.

Design of the extension in accordance with the present invention makes it possible for the constructing engineer to determine the timing period of the retracting movement of the two brake arms.

The present invention also encompasses an expedient by means of which an advantageous design of the connecting link is brought about in conjunction with separated supporting surfaces and guide surfaces.

The present invention is further distinguished by the fact that guidance of the connecting link extension is positive. When this is done, the ends of the spiral springs can be directly braced against the base plate and thereby be independent of the extension. As a result, it also becomes possible to use a single erecting or mounting spring, which can, in addition, be mounted easily.

It would be conceivable to link the free ends of both legs of the extension of the connecting link with a pin passing through a clearance in the rib. However, this would mean additional assembly. This disadvantage is avoided as a result of the present invention.

Finally, the present invention is distinguished by an especially simple structure, in which greater latitude is available to the constructing engineer in the determination of the distance between the guide surface and the supporting surface.

BRIEF DESCRIPTION OF THE DRAWINGS

In the drawings, embodiments of a ski brake according to the invention are shown schematically by way of example.

FIG. 15 is a sectional view of the ski brake in the braking position, and FIG. 16 is a corresponding top view.

FIGS. 17 and 18 depict this ski brake in the standby position, as in FIGS. 5 and 6.

Figure 1:
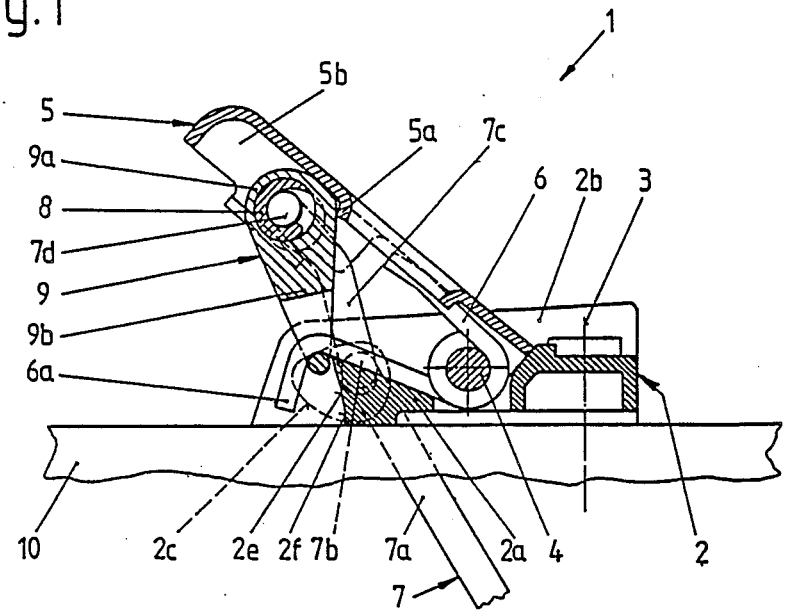
FIG. 1 is a cross-sectional view taken along the line I—I of FIG. 2 through an initial embodiment in the braking position.

For the sake of simplicity, the ski was not depicted in any of the top views.

DETAILED DESCRIPTION OF THE DRAWINGS

The ski brake depicted in FIGS. 1–6 is shown generally at 1. It has a base plate 2 (with a foot 2*a*) that is attached to a ski 10, e.g. by means of screws 3. Upward-extending ledge-shaped side segments 2*b* are attached to the foot 2*a* and extend longitudinally along the ski brake 1. A lateral axis 4 is attached in holes in both side segments 2*b*. An actuating treadle or release lever 5 on the one hand, and two erecting springs formed as spiral springs 6 on the other hand are fulcrumed at this axis. The actuating treadle 5 has a limit stop 5*a* and two bent-aside tabs 5*b*.

At a distance from the lateral axis 4, funnel-shaped radial bores 2*c* are hollowed out in both side segments 2*b* of the base plate 2. In these holes two wire brake arms 7 and their laterally running segments 7*b* are pivotally mounted. Each wire brake arm 7 has a segment located outside the base plate 2. This segment will hereinafter be referred to as the brake mandrel 7*a* and may have a plastic extrusion (not shown in the drawing), that, if present, serves as a brake blade. Segment 7*b*, which was already mentioned, has a segment 7*c*, connected to 7*b* and running approximately parallel to segment 7*a*, and an end segment 7*d*, connected in an obtuse angle to segment 7*c*, are the remaining segments of the wire brake arm 7. The end segments 7*d* of the two wire brake arms 7 are directed towards each other and connected with each other by means of a connecting spring 8. The end segments 7*d* of the wire brake arms 7 are pivoted in the actuating treadle 5 in a manner known in the prior art therefore not described more fully herein.

A connecting link 9, which has a cylindrical sleeve 9*a* and an extension 9*b* that is connected to this sleeve, is mounted on the connecting spring 8, which is formed as a coil spring. The extension 9*b* runs approximately radially to the cylindrical sleeve 9*a*. This extension 9*b* is framelike in design, whereby the angled ends 6*a* of both spiral springs 6 are nested in the frame. The other ends of the spiral springs are braced against the bottom of the actuating treadle 5. The sleeve 9*a* of the connecting link 9 has a bore which is enlarged into a slot towards both sides of the ski brake 1 (cf. FIG. 7 in particular). As a result, a pivoting apart of the end segments 7*d* of the two wire brake arms 7 with reduced friction is promoted and their jamming prevented.

Figure 2:
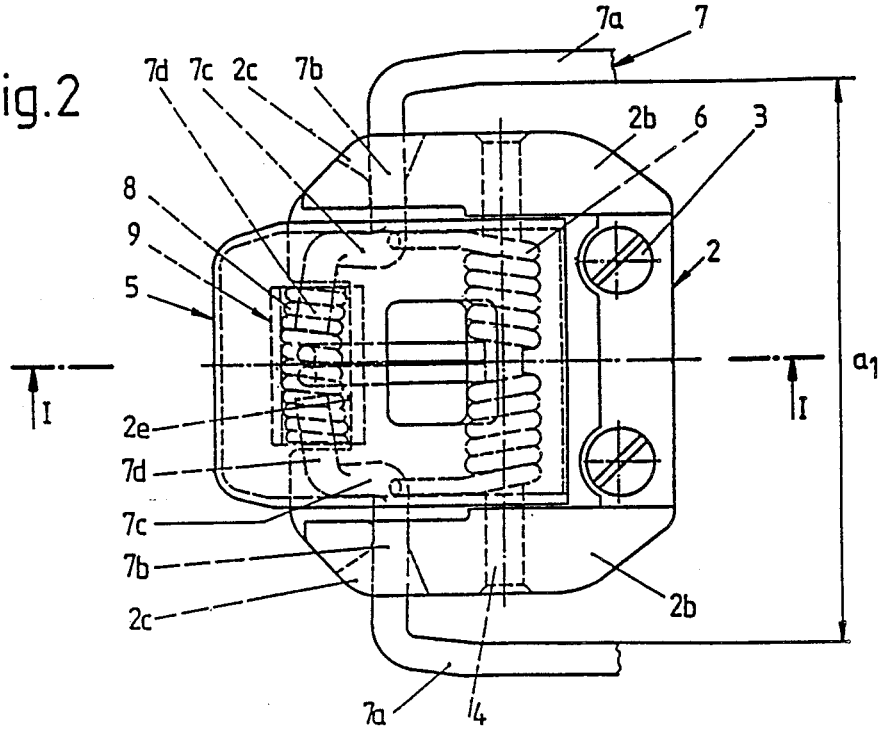
FIG. 2 is a corresponding top view.

In the brake position of ski brake 1 depicted in FIGS. 1 and 2, the extension 9*b* of the connecting link 9 is away from the top of the ski 10. The connecting link 9 is thus held by the angled ends 6*a* of the two spiral springs 6 in a position in which the sleeve 9*a* abuts the limit stop 5*a* of the actuating treadle 5.

Figure 3:
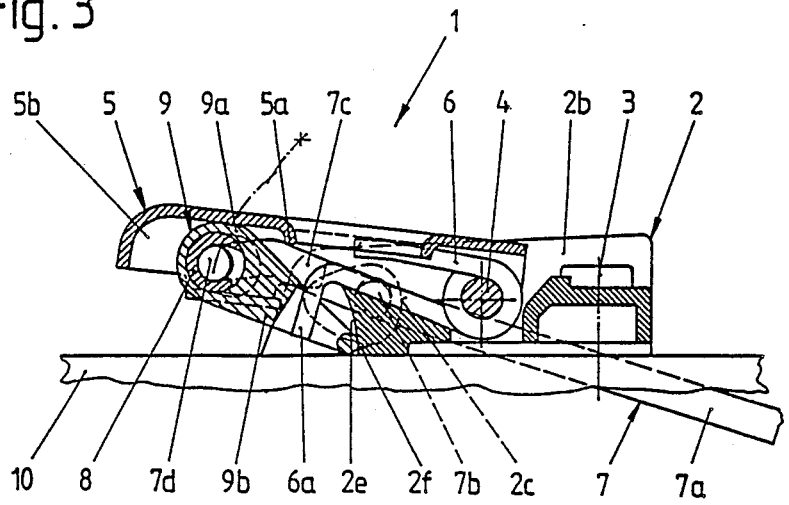
FIGS. 3 and 4 show the ski brake during depression of the actuating treadle: in a cross-sectional view taken along the line III—III of FIG. 4, and in top view.
Figure 4:
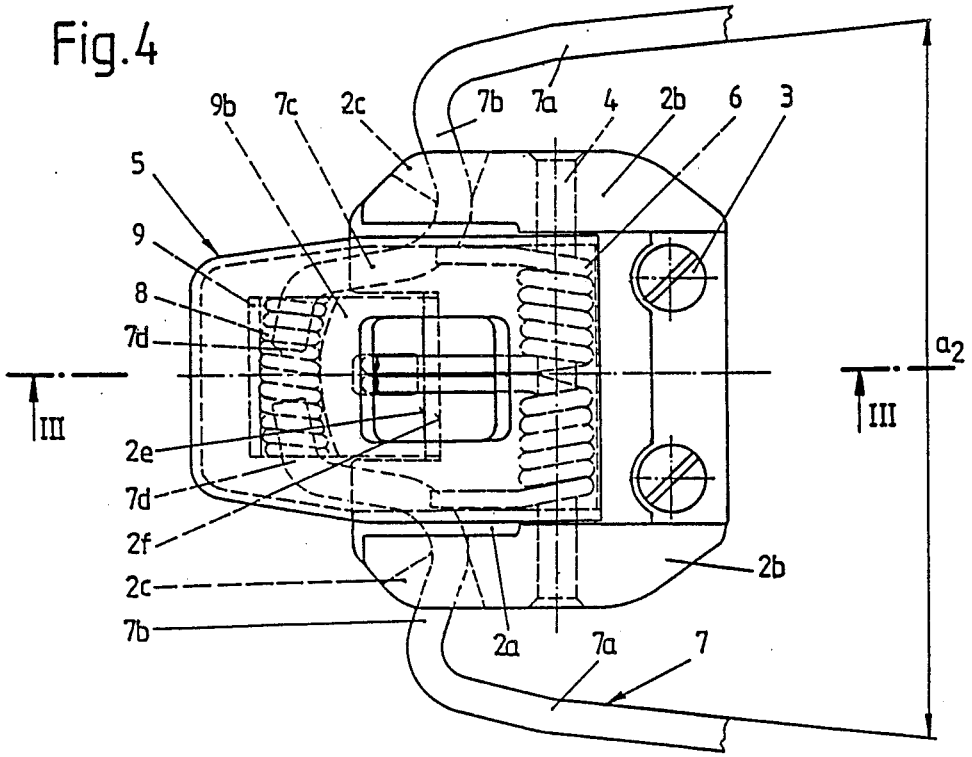
Figure 5:
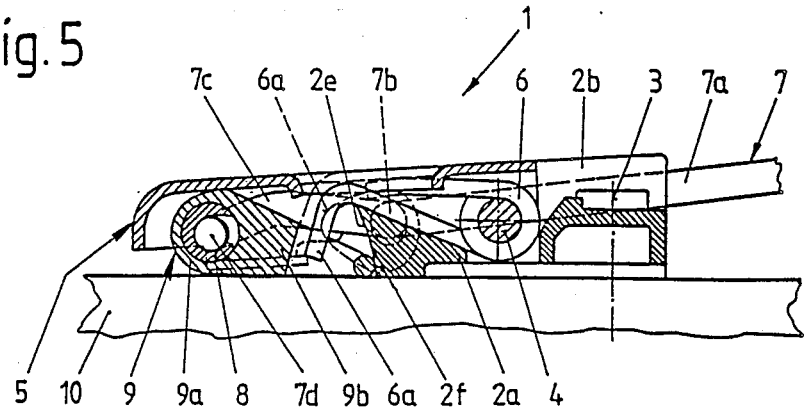
FIG. 5 is a cross-sectional view of the ski brake in the standby position taken along the line V—V of FIG. 6.
Figure 6:
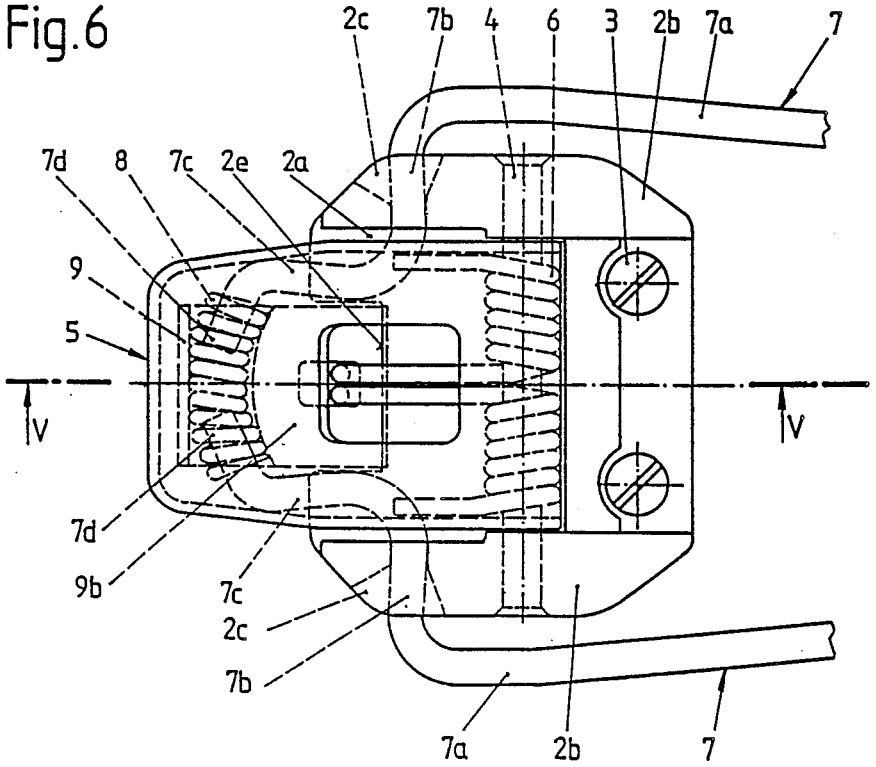
FIG. 6 is a corresponding top view.

If force is exerted on the actuating treadle 5 by a ski boot (not depicted) and the treadle is swung downward as a result, the end of the extension 9*b* arrives at a point where it is abutting the top of the ski 10 as well as the base plate 2. This position of the connecting link 9 is depicted in FIGS. 3 and 4. Before this position is reached, the end of the extension 9*b* may slide along a guide surface 2*e* of the base plate 2, if required. In the process, the sleeve 9*a* of the connecting link 9 has moved away somewhat from the limit stop 5*a* of the actuating treadle 5. If the pressure exerted on the actuating treadle 5 is increased, the free end of the actuating treadle 5 is pressed further towards the top of the ski (see FIGS. 5 and 6). Therewith, in the final position (i.e. in the standby position of the ski brake 1), the connecting link 9 is braced with its extension 9*b* against the force of the connecting spring 8 on a portion of the guide surface 2*e* that acts as a supporting surface 2*f*. In this position, the end segments 7*d* of both wire brake arms 7 are at their farthest point away from the lateral axis 4, and both segments 7*a* are swung in towards the vertical longitudinal medium plane of the ski brake 1. The displacement of the end segments 7*d* longitudinally along the actuating treadle is effected essentially on the basis of the toggle principle.

The following is to be noted with respect to the upward swivelling motion of the two brake mandrels 7*a*: In the braking position of ski brake 1, the distance between the free ends of the two brake mandrels 7*a* of the wire brake arms 7 is a1. This distance increases to a2 in the partially depressed position of ski brake 1 (see FIGS. 3,4), whereby the free ends of the brake mandrels 7*a* are a greater distance away from both of the side faces of the ski 10. It thereby becomes possible for both brake mandrels 7*a* of the wire brake arms 7 to clear both side faces of the ski more easily and without the danger of getting caught up.

Figure 8:
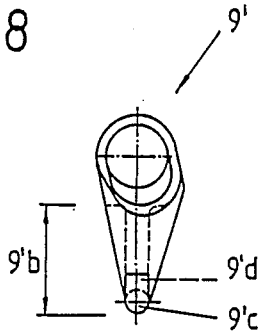
FIG. 8 is a corresponding side view. A third embodiment of the ski brake is represented in FIGS. 9–14.
Figure 7:
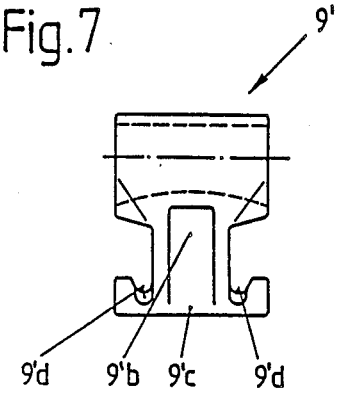
FIG. 7 has a front view of the connecting link of a second embodiment.

A modification of the design of the connecting link 9′ is depicted in FIGS. 7 and 8. The extension 9′*b* of connecting link 9′ is T-shaped in the top view. Grooves 9′*d* are recessed in the laterally running segment 9′*c* of the extension 9′*b*. These grooves serve to accept the hook-shaped, bent-aside ends of the two leg springs, springs that are intended to raise up the actuating treadle.

Otherwise, the design of this exemplary embodiment corresponds to that of the embodiment described initially. The function is the same in both cases as well.

The embodiment of a ski brake 1″ depicted in FIGS. 9–14 is similar to the embodiment described initially. It too has a base plate 2″ (with a foot 2″*a*) that is fastened to a ski 10″ by means of screws 3″. Upward-extending side segments 2″*b* are attached to the foot 2″*a* and extendlongitudinally along the ski brake 1″. A lateral axis 4'' is attached in these side segments 2''b . An actuating treadle 5'' and two mounting springs for the actuating treadle 5'', formed as spiral springs 6'', are pivoted on this axis. The actuating treadle 5'' has a limit stop 5''a and two bent-aside tabs 5''b.

At a distance from the lateral axis 4'', funnel-shaped radial bores 2''c are hollowed out in both side segments 2''b of the base plate 2''. In these holes, two wire brake arms 7'' with their laterally running segments 7''b are pivotally mounted. The wire brake arms 7'' are identical to those depicted in FIGS. 1 to 6.

A connecting link 9'', which has a cylindrical sleeve 9''a and an extension 9''b that is connected to the sleeve, is mounted on the connecting spring 8''. The extension 9''b is divided into a first segment 9''g (which faces towards the sleeve 9''a) and a second segment 9''h (which adjoins the first), whereby the second segment 9''h runs at an angle with respect to the first segment 9''g. The extension 9''b is framelike in design in its central latitudinal region 9''e, whereby the angled ends 6''a of both spiral springs 6'' are nested in the frame. The other ends of the spiral springs are braced against the bottom of the actuating treadle 5''. Connecting link 9'', in its sleeve 9''a, has a bore which is enlarged into a slot towards the sides of the ski brake 1'.

In contrast to the embodiments described hereinabove, projections 9''f are constructed on both sides of the first segment 9''g of the extension 9''b in the case of ski brake 1'' . In addition to this, base plate 2'' has two supporting surfaces 2''f, which are provided on projections of the base plate 2'' and are intended for the abutment of the cams 9''f. In the case of ski brake 1'' , the supporting surfaces 2''f of the base plate 2'' are thereby displaced (with respect to the lateral axis 4'' of the actuating treadle 5'') in the direction of the connecting spring 8''. Because of this arrangement, the designer can more easily specify those constructional measures that are necessary for the retraction of the free ends of the wire brake arms 7'' into the standby position.

Figure 9:
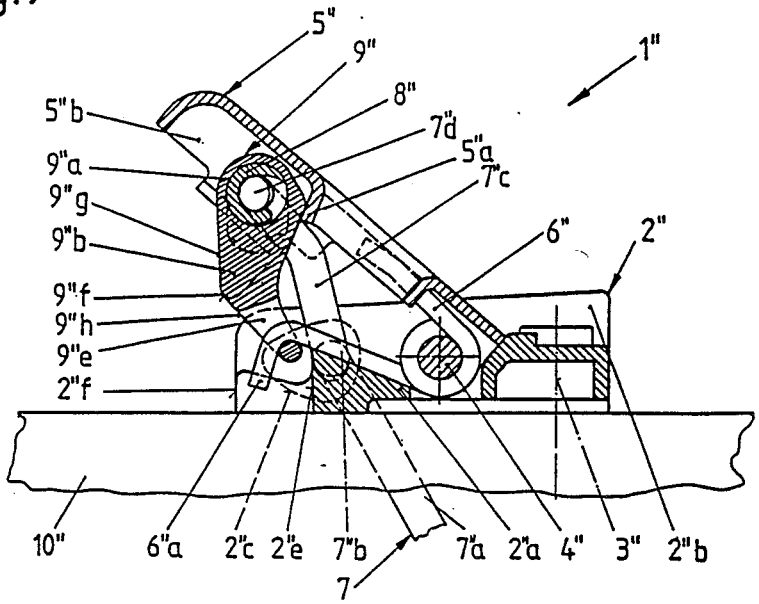
FIG. 9 is a cross-sectional view of the ski brake in the braking position taken along line IX—IX of FIG. 10, and, FIG. 10 is a corresponding top view.
Figure 10:
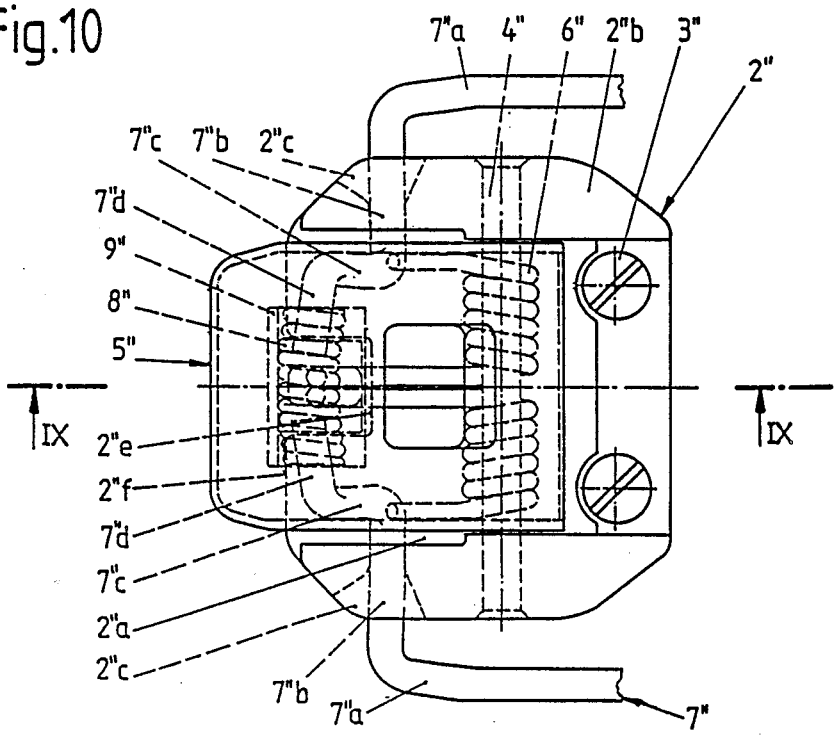

In the brake position of ski brake 1'' depicted in the FIGS. 9 and 10, the connecting link 9'' is held by the angled ends 6''a of the two spiral springs in a position in which the sleeve 9''a abuts the limit stop 5''a of the actuating treadle 5''.

Figure 11:
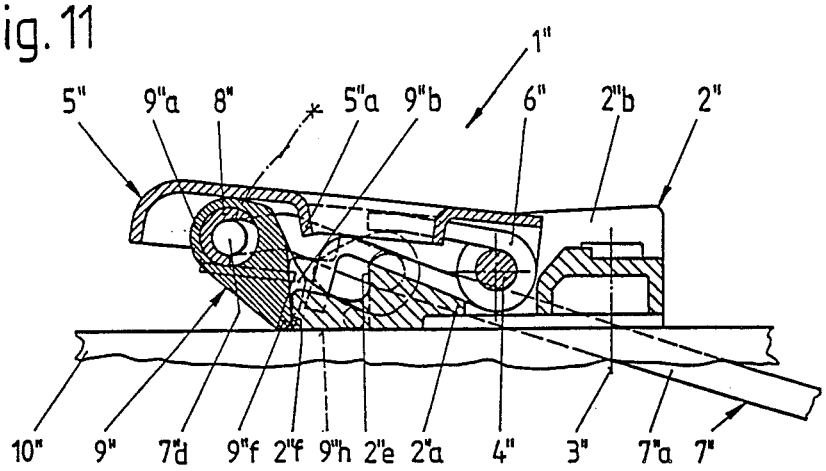
FIG. 11 is a sectional view of this ski brake during depression of the actuating treadle taken along the line XI—XI of FIG. 12.
Figure 12:
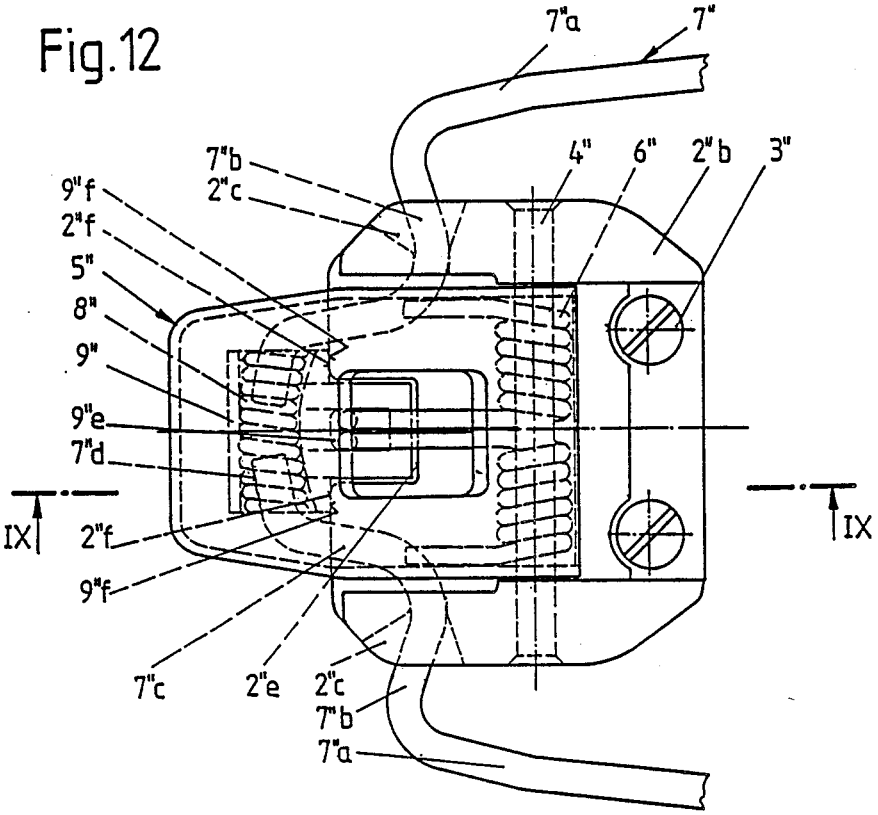
FIG. 12 is a corresponding top view.

If force is exerted on the actuating treadle 5'' by a ski boot (not shown epicted) and the treadle is swivelled downwards as a result, the second segment 9''h of the extension 9''b and both cams 9''f arrive at a point where they are abutting the top of the ski 10. At the same time, the projections ams 9''f are positioned up against the two supporting surfaces 2''f. This position of the connecting link 9'' is depicted in FIGS. 11 and 12. In this case, the sleeve 9''a of the connecting link 9'' has moved away somewhat from the limit stop 5''a of the actuating treadle 5''.

Figure 13:
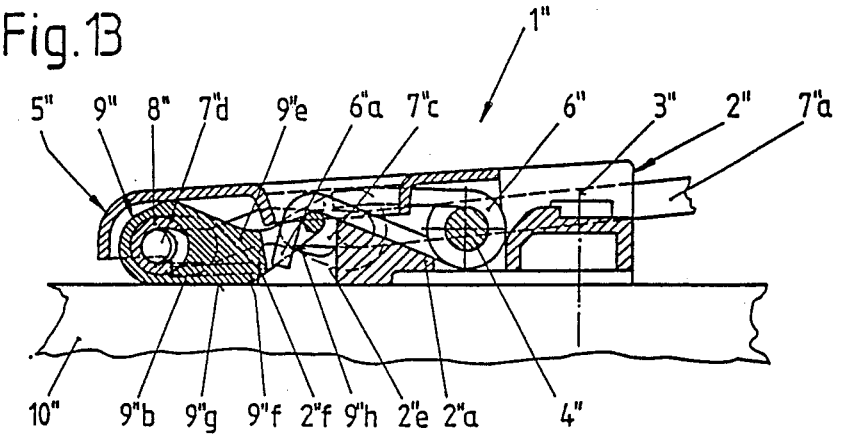
FIG. 13 is a cross-sectional view taken along the line XIII—XIII of the ski brake in the standby position.
Figure 14:
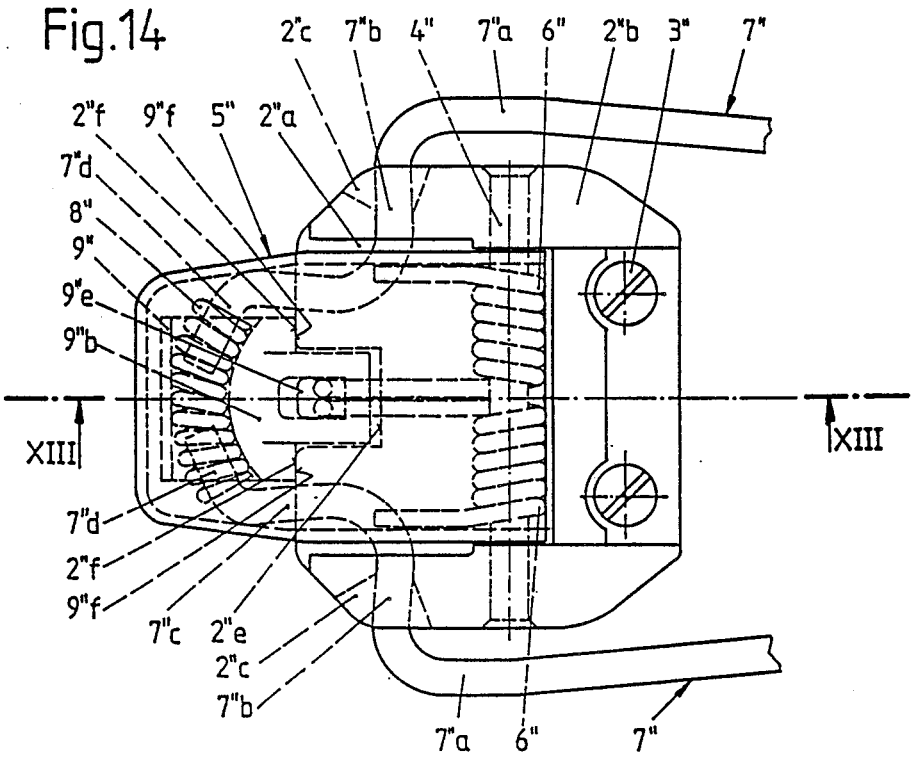
FIG. 14 is a corresponding top view.

If the pressure exerted on the actuating treadle 5'' is increased, the free end of the actuating treadle 5'' is pressed further towards the top of the ski 10''. However, the result is that the second segment 9''h of the extension 9''b is swung upwards. When this occurs, the free end area of the second segment 9''h of the extension 9''b travels upwards. In the final position of ski brake 1'' (as shown in FIGS. 13 and 14), which corresponds to the standby position, the end segments 7''d of the two wire brake arms 7'' are at their farthest point away from the lateral axis 4'', and both segments 7''a are swung in towards the vertical longitudinal medium plane of the ski brake 1''.

The final embodiment of a ski brake 1''' (pictured in the FIGS. 15–20) also has a base plate 2''' (with a foot 2'''a) to which upward-extending side segments 2'''b are attached. The base plate 2''' is attached to the top of the ski 10''' by means of screws 3'''. A lateral axis 4''' is attached in these side segments 2'''b. An actuating treadle 5''' and mounting springs 6''' are placed on this axis.

Wire brake arms 7''', pivoted in the holes 2'''c of the side segments 2'''b, are connected to each other at their end segments 7'''d. These end segments are mounted in the actuating treadle 5''' and are linked by a connecting spring 8'''. A connecting link 9''', consisting of a cylindrical sleeve 9'''a and an extension 9'''b connected to the sleeve, is placed on the connecting spring 8'''. However, in contrast to the previous embodiments, the extension 9'''b of the connecting link 9''' is shaped in the form of a U (viewed from the top), whereby the free ends of the legs 9'''k have inwardly pointing projections 9'''i (see FIG. 20 especially).

A pedestal 2'''g, which faces away from the lateral axis 4''' and has a substantially I-shaped cross section, is attached to the base plate 2''' and runs along the vertical longitudinal medium plane. Two grooves 2'''h of the pedestal 2'''g serve here to guide the projections 9'''i of the connecting link 9'''. A supporting surface 2'''f in the form of a projection is constructed on the front of the pedestal 2'''g.

Figure 15:
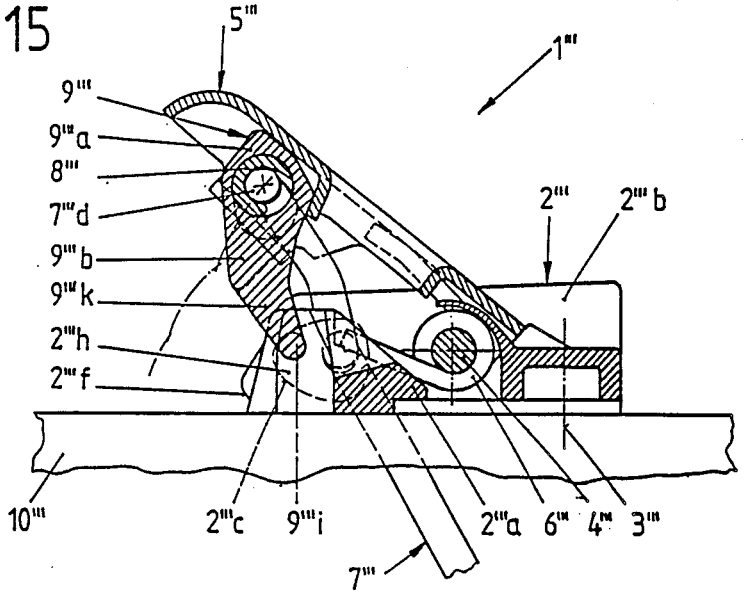
FIGS. 15–17 illustrate a fourth embodiment of the ski brake, whereby
Figure 16:
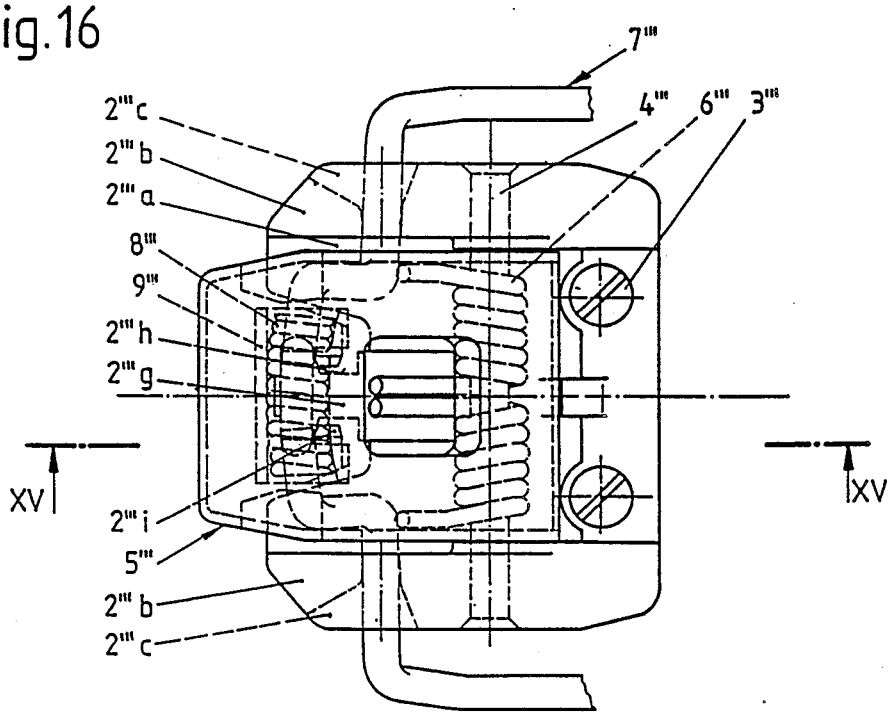
Figure 17:
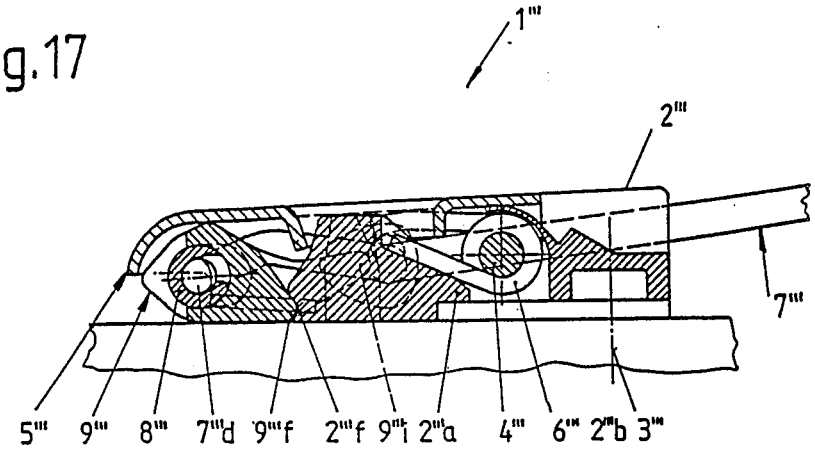
Figure 18:
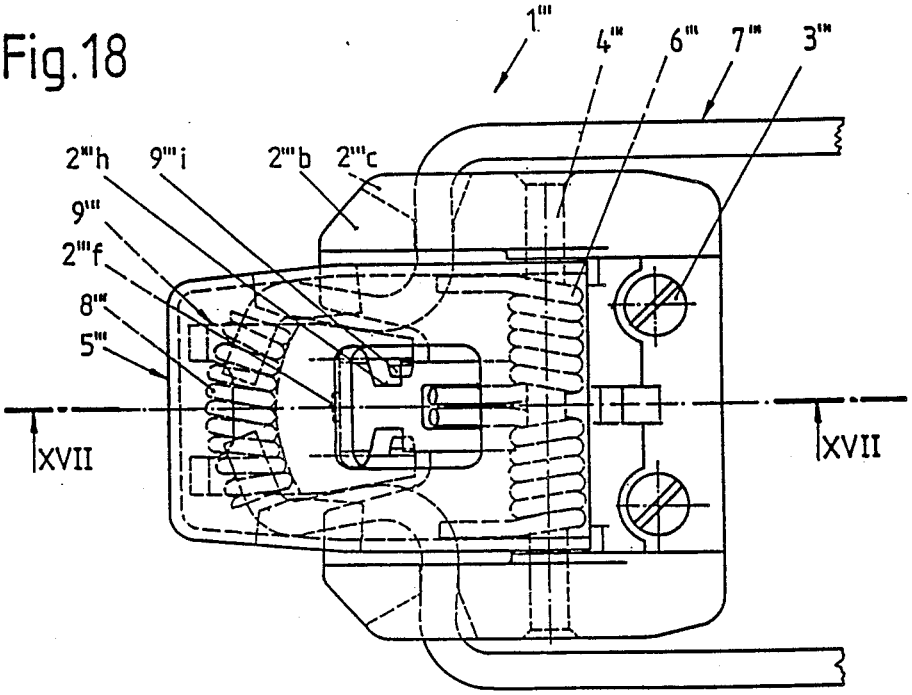

In related views, FIGS. 15 and 16 show the ski brake 1''' described above in the braking position; FIGS. 17 and 18 show it in the standby position. The operation of this ski brake 1''' essentially corresponds to that of the ski brakes 1 and 1'' described above. In this context, the differing positions of the projections 9'''i of the connecting link 9''' as shown in FIGS. 16 and 18 should be noted.

Figure 19:
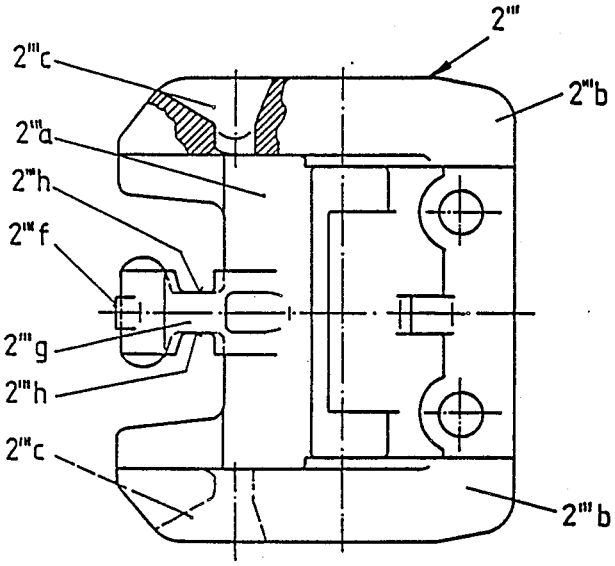
FIG. 19 depicts a top view onto the base plate.
Figure 20:
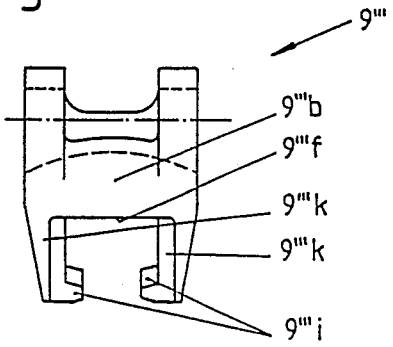
FIG. 20 a top view onto the connecting link.

Furthermore, the construction and details of the base plate 2''' can be seen especially clearly in FIG. 19, because the additional parts of the braking device have not been included here. FIG. 20 illustrates the connecting link 9''' that is being used here.

The invention is not limited to the embodiments illustrated in the drawing and described above. Rather, various modifications of these embodiments are conceivable without going beyond the scope of the invention. For example, ski brakes are also to come under the protection of the invention whose connecting link has such a large recess in the area of the sleeve that only two bosses remain (bosses which are braced directly against the end segments). Furthermore, connecting links in which the design and arrangement of the guiding and supporting elements are combined from the models described are to be protected as well. It would also be possible, with the ski brake in the standby position, for the connecting link to abut the foot of the base plate instead of abutting the top of the ski if this foot were accordingly larger in its design.

If the end segments (which support the connecting spring) of both brake arms are angled outwardly, the connecting spring will have an opening in its middle section for passing through these end segments. This opening can be formed by appropriate spaces between the windings of the connecting spring.

Furthermore, the connecting spring can also be constructed as a bar spring, leaf spring, or as a specially fabricated spring made from a synthetic material or rubber.

We claim:

1. A ski brake for a ski having a longitudinal axis, a top surface and a running surface, comprising:

a base plate mounted on the ski and including at least one support surface formed thereon;

a release lever pivotally mounted on the base plate and biased away from the top surface of the ski by the force of at least one mounting spring;

a plurality of brake arms pivotally mounted on the base plate, each of the brake arms having a journaled end pivotally mounted in the release lever and a free end and being movable between an operating position and a rest position, wherein in the operating position, the brake arms are pivoted so that the free ends extend beyond the running surface of the ski, and in the rest position the brake arms are pivoted so that the free ends are disposed substantially parallel to the longitudinal axis of the ski;

a connecting spring for connecting the journaled end of each of the brake arms; and a connecting link hingedly mounted to the journaled ends of the brake arms, the connecting link including a cylindrical sleeve for receiving the journaled ends and an extension extending from the cylindrical sleeve, wherein the extension is held against the force of the connecting spring on the at least one support surface of the base plate when the brake arms are in the rest position.

2. The ski brake as claimed in claim 1, wherein the connecting link is mounted on the connecting spring and a clearance is provided between the connecting link and the journaled ends of each of the brake arms.

3. The ski brake as claimed in claim 1, wherein the cylindrical sleeve of the connecting link includes a bore tapering gradually inwardly towards the mid-plane of the connecting link from a portion of the connecting link mounted contiguous with the longitudinal axis of the ski.

4. The ski brake as claimed in claim 1, wherein the at least one mounting spring comprises two springs and the ends of the springs are disposed in the extension and are spaced from the release lever.

5. The ski brake as claimed in claim 1, wherein the base plate further includes at least one guide surface for guiding the extension of the connecting link during the pivotal movement of the brake arms so that the guide surface is disposed in engagement with the support surface.

6. The ski brake as claimed in claim 5, wherein the at lest one mounting spring comprises two springs and the extension has an opening and the ends of the two mounting springs are fitted into the opening and further wherein the extension is slidably guided along the guide surface.

7. The ski brake as claimed in claim 5, wherein the extension in substantially T-shaped in configuration and wherein the connecting link further includes a segment extending transversely to the longitudinal axis of the ski and having a plurality of grooves framed therein, the connecting link being slidably guided along the guide surface of the base plate and held against the support surface of the base plate.

8. The ski brake as claimed in claim 5, wherein the support surface of the base plate is spaced from the guide surface in the direction of the connecting spring.

9. The ski brake as claimed in claim 1, wherein the connecting link extension is divided into a first segment and a second segment, wherein the first segment adjoins the cylindrical sleeve and the second segment adjoins the first segment and is disposed in angular relationship to the first segment.

10. The ski brake as claimed in claim 9, wherein the connecting link further includes a plurality of projections disposed laterally adjacent the first segment of the extension and in opposition to the support surfaces.

11. The ski brake as claimed in claim 1, wherein the base plate further includes a pedestal, and the extension of the connecting link is substantially U-shaped in configuration and includes a plurality of legs for guiding the extension along the pedestal of the base plate.

12. The ski brake as claimed in claim 11, wherein the pedestal is substantially I-shaped in cross-section and includes a plurality of grooves, and further wherein the legs of the extension include a plurality of projections extending inwardly towards the center of the release lever and adapted to fit in the grooves of the pedestal.

13. The ski brake as claimed in claim 11, wherein the support surface comprises a shoulder formed on a first end of the pedestal, and further wherein the support surface is held against the extension and extends between the plurality of legs.

* * * * *